US006340321B2

(12) United States Patent
Sawayanagi

(10) Patent No.: US 6,340,321 B2
(45) Date of Patent: Jan. 22, 2002

(54) ELECTRICAL CONNECTOR

(75) Inventor: Masahiro Sawayanagi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/799,586

(22) Filed: Mar. 7, 2001

(30) Foreign Application Priority Data

Mar. 9, 2000 (JP) ..... 12-064555

(51) Int. Cl.[7] ..... H01R 4/10
(52) U.S. Cl. ..... 439/877
(58) Field of Search ..... 439/596, 752, 439/877, 882, 887, 879, 904, 467

(56) References Cited

U.S. PATENT DOCUMENTS

| | | | | |
|---|---|---|---|---|
| 3,332,053 A | * | 7/1967 | Busler | 439/596 |
| 4,660,914 A | | 4/1987 | Nakamura | 439/596 |
| 5,292,261 A | | 3/1994 | Hirano et al. | 439/752 |
| 5,322,456 A | | 6/1994 | Yagi et al. | 439/595 |
| 6,027,374 A | * | 2/2000 | Nagai et al. | 439/596 |
| 6,109,975 A | * | 8/2000 | Nitta | 439/686 |
| 6,116,954 A | * | 9/2000 | Ries | 439/596 |
| 6,176,740 B1 | * | 1/2001 | Abe et al. | 439/596 |

FOREIGN PATENT DOCUMENTS

| | | |
|---|---|---|
| EP | 0 698 944 A1 | 2/1996 |
| WO | 96/05632 | 2/1996 |

* cited by examiner

*Primary Examiner*—Tulsidas Patel
(74) *Attorney, Agent, or Firm*—Finnegan, Henderson, Farabow, Garrett & Dunner, L.L.P.

(57) ABSTRACT

The connector has a first housing (4) comprised of a connector terminal (1), a terminal accommodating chamber (3) in which the connector terminals (1) are disposed in a direction in which a mating connector (2) is to be inserted, and terminal insertion holes (4) in the terminal accommodating chamber (3) in which each joint portion is embedded and a second housing (7) having a connector insertion hole (5) allowing the mating connector (2) to be inserted in and engaged with and capable of being mounted integratedly with the terminal accommodating chamber (3) of the first housing (4) through the hinge portion (6). The connector further comprises a terminal pressing member for pressing the joint portion (11) of the connector terminal disposed in the terminal insertion hole (14) when the second housing is coupled with the first housing (4), the terminal pressing member (21) being provided on an outer side face of the second housing (7).

11 Claims, 5 Drawing Sheets

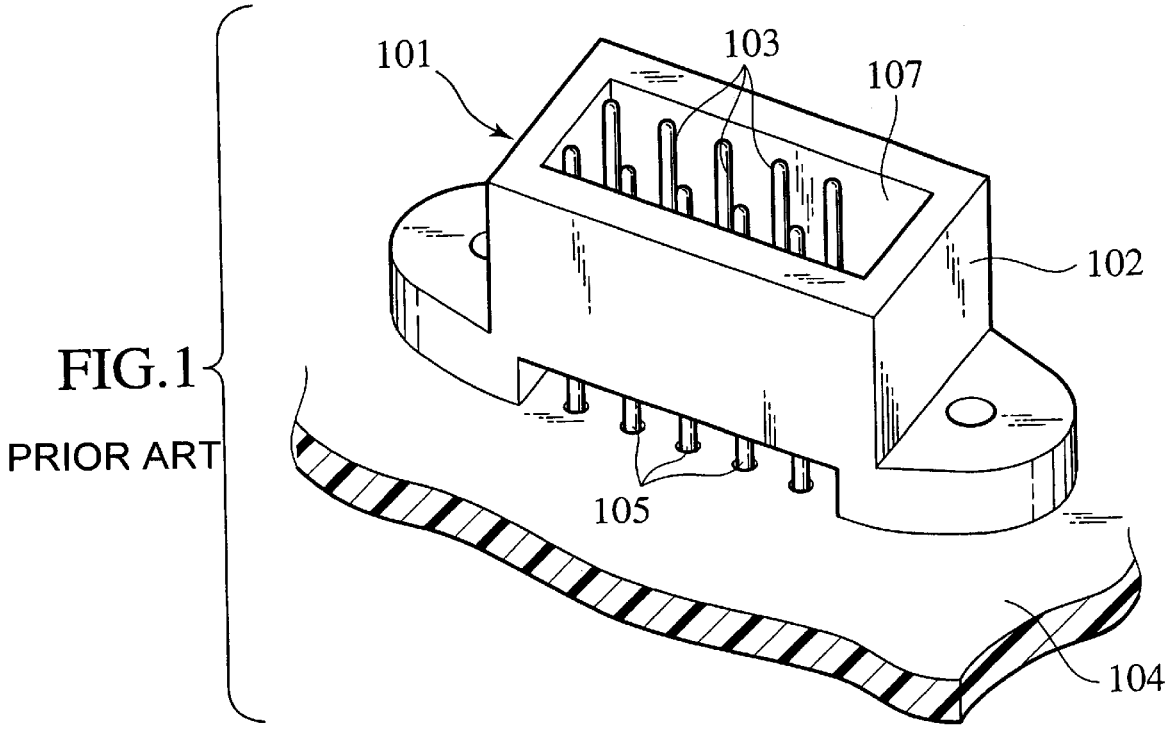
FIG.1 PRIOR ART
FIG.2 PRIOR ART
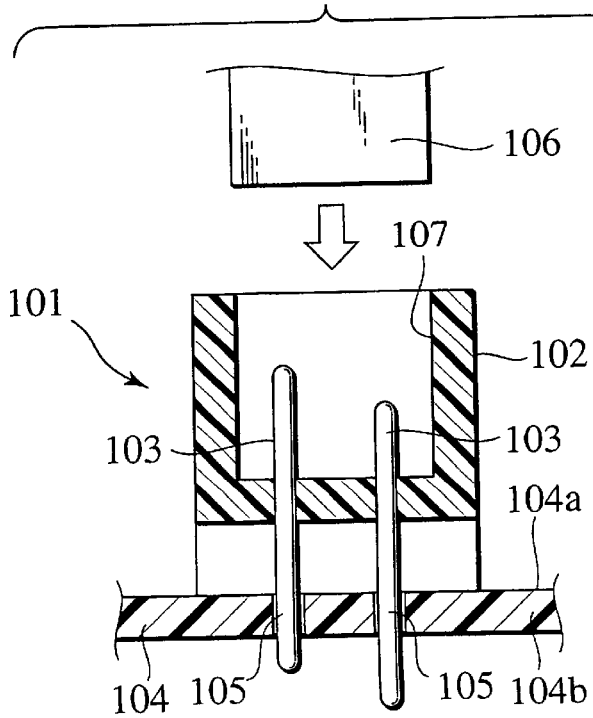

ELECTRICAL CONNECTOR

BACKGROUND OF THE INVENTION

The present invention relates to a connector capable of accommodating terminals in its accommodating chamber, and more particularly to a connector which achieves improvement of insertion performance of each terminal into the terminal accommodating chamber, prevention of the terminal from being slipped out and improvement of mechanical strength of the connector.

In a substrate connector 101, for example, as shown in FIG. 1, a plurality of terminals 103 are disposed in its connector housing 102 and the respective terminals 103 are inserted into through holes 105 formed in a printed wiring board 104. A land portion of the wiring pattern is connected to the terminals 103 by soldering, so that the substrate connector 101 is mounted on the printed wiring board 104.

In the substrate connector 101, as shown in FIG. 2, a mating connector 106 is inserted into a terminal accommodating chamber 107 of the connector housing 102. By coupling the mating connector 106 with the substrate connector 101, a terminal (not shown) of the terminal connector 106 comes into contact with the terminal 103 in the substrate connector 101.

The terminal 103 provided in the connector housing 102 may be protruded to the side of a rear face 104*b* opposite to a connector mounting face 104*a* of the printed wiring board 104 because of a contact load on the terminal when and after the mating connector 106 is coupled.

On the other hand, in a so-called wire connector in which a wire is connected, as shown in FIG. 3, wires 111, 112 are connected to a terminal 110 and another terminal (not shown) respectively in respective connector housings. By coupling a female connector 113 to a male connector 114, the terminals are coupled with each other.

However, in case of the wire connector, after the connectors are coupled with each other, the terminal 110 may be slipped out of the connector housing 109 because of an unexpected external force. To prevent this phenomenon, it is necessary to provide the connector housing 109 with a double fixing member 115 for preventing the terminal 110 from being slipped out as shown in FIG. 3. To provide with the double fixing member 115, a hole needs to be formed in the connector housing 109. Further, the double fixing member 115, which is a small part, needs to be produced especially, thereby leading to increases of production cost and production steps.

As described above, in the substrate connector 101 and wire connector 113, the terminals 103, 110 may be slipped out or the double fixing member 115 for preventing an escape of the terminal 110 is necessary, so that the increases of production cost and production steps cannot be avoided.

Accordingly, the present invention has been proposed to solve the above described problem and therefore, an object of the invention is to provide a connector having a high mechanical strength, capable of securing a smooth insertion of a terminal into a terminal accommodating chamber and preventing an escape of the terminal from the terminal accommodating chamber.

SUMMARY OF THE INVENTION

According to a first aspect of the present invention, the connector comprises: a connector terminal constituted of a wire connecting portion, to which a wire is connected, a terminal contact portion, which a mating terminal contacts and a joint portion for joining the wire connecting portion to the terminal contact portion, the wire connecting portion and the terminal contact portion being joined to the joint portion through an end of each thereof while the other end of each thereof being disposed in the same direction; a first housing having a terminal accommodating chamber in which the connector terminal is inserted and disposed in the same direction in which the mating connector is inserted; and a second housing having a connector insertion hole, through which the mating connector is to be inserted and mounted integratedly with the terminal accommodating chamber of the first housing through a hinge portion. The second housing is provided with a terminal pressing member for pressing the joint portion of the connector terminal inserted into the terminal insertion hole when the second housing is coupled with the first housing.

Therefore, the connector housing is so constructed that it is divided to the first housing having the terminal accommodating chamber and the second housing having the connector insertion hole through which the mating connector is to be inserted and the second housing can be coupled with the first housing through the hinge portion. Thus, when the second housing is separated from the first housing, the connector terminal can be mounted in the terminal accommodating chamber easily.

When the second housing is coupled with the first housing, the terminal pressing member formed on the second housing presses the joint portion of the connector terminal disposed in the terminal insertion hole formed in the terminal accommodating chamber. Thus, the connector terminal is prevented from being slipped out of the terminal accommodating chamber.

Further, the wire connecting portion and the terminal contact portion of the connector terminal are not provided on the same line, but disposed on the joint portion by joining the proximal ends thereof to the joint portion, such that the other ends thereof are directed in the same direction. As a result, reduction of the size of the connector terminal can be achieved, thereby making it possible to reduce the size of the connector itself.

According to a second aspect of the present invention, a lock means for maintaining the coupling condition of the first housing and the second housing is provided.

Therefore, because the lock means for maintaining the coupling condition of the first housing and the second housing is provided, when the first and second housings are coupled with each other, the coupling condition can be maintained unless the lock means is released. Then, by releasing the lock means, the second housing can be separated from the first housing easily.

BRIEF DESCRIPTION OF THE DRAWINGS

FIG. 1 is a perspective view showing a condition in which a conventional substrate connector is mounted on a printed wiring board;

FIG. 2 is a sectional view showing a condition in which terminals are protruded from a connector housing when a mating connector is mounted on the substrate connector shown in FIG. 1;

DESCRIPTION OF THE PREFERRED EMBODIMENT.

<Structure of Connector>

Figure 3:
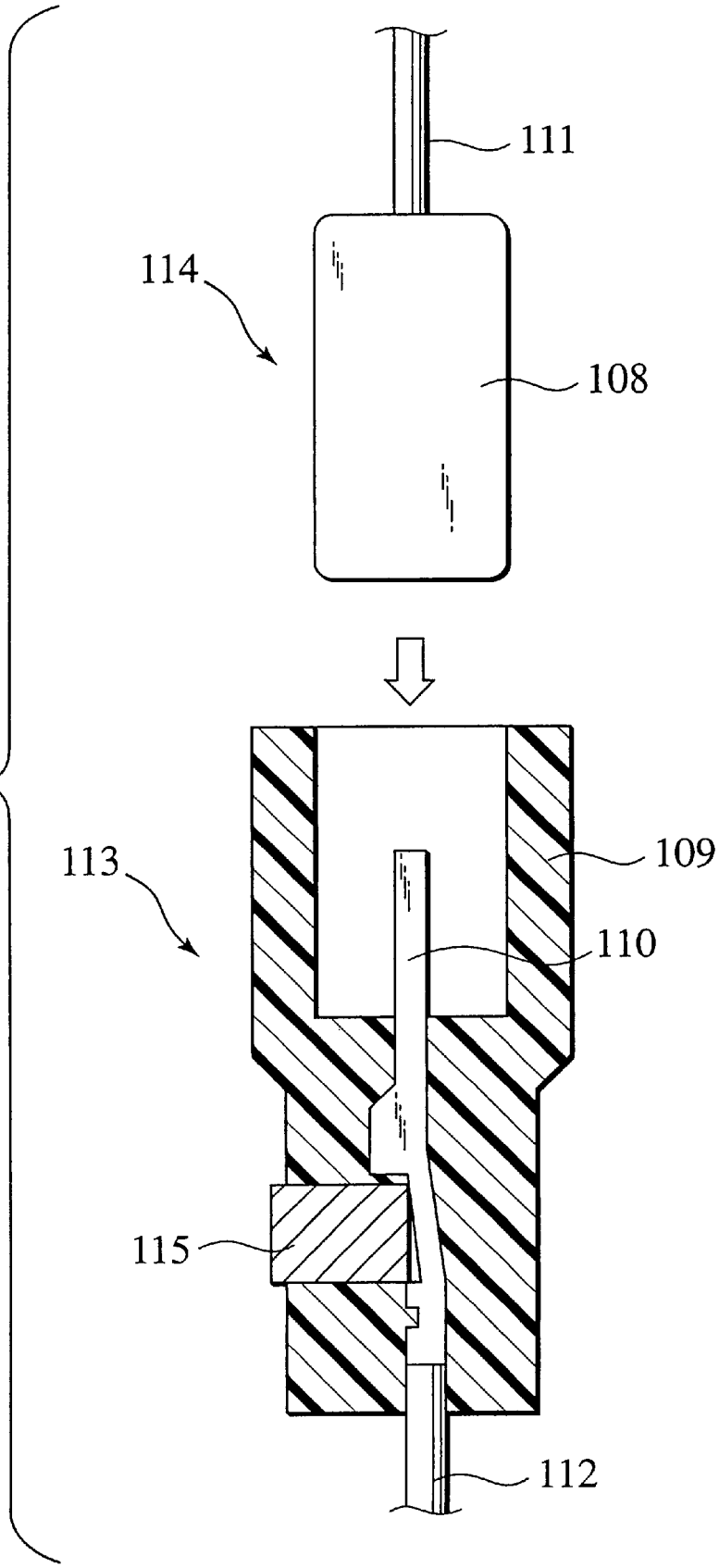
FIG.3 PRIOR ART
FIG. 3 is a sectional view showing a condition in which a wire connector on which a double fixing member is produced is connected to a mate connector.
Figure 4:
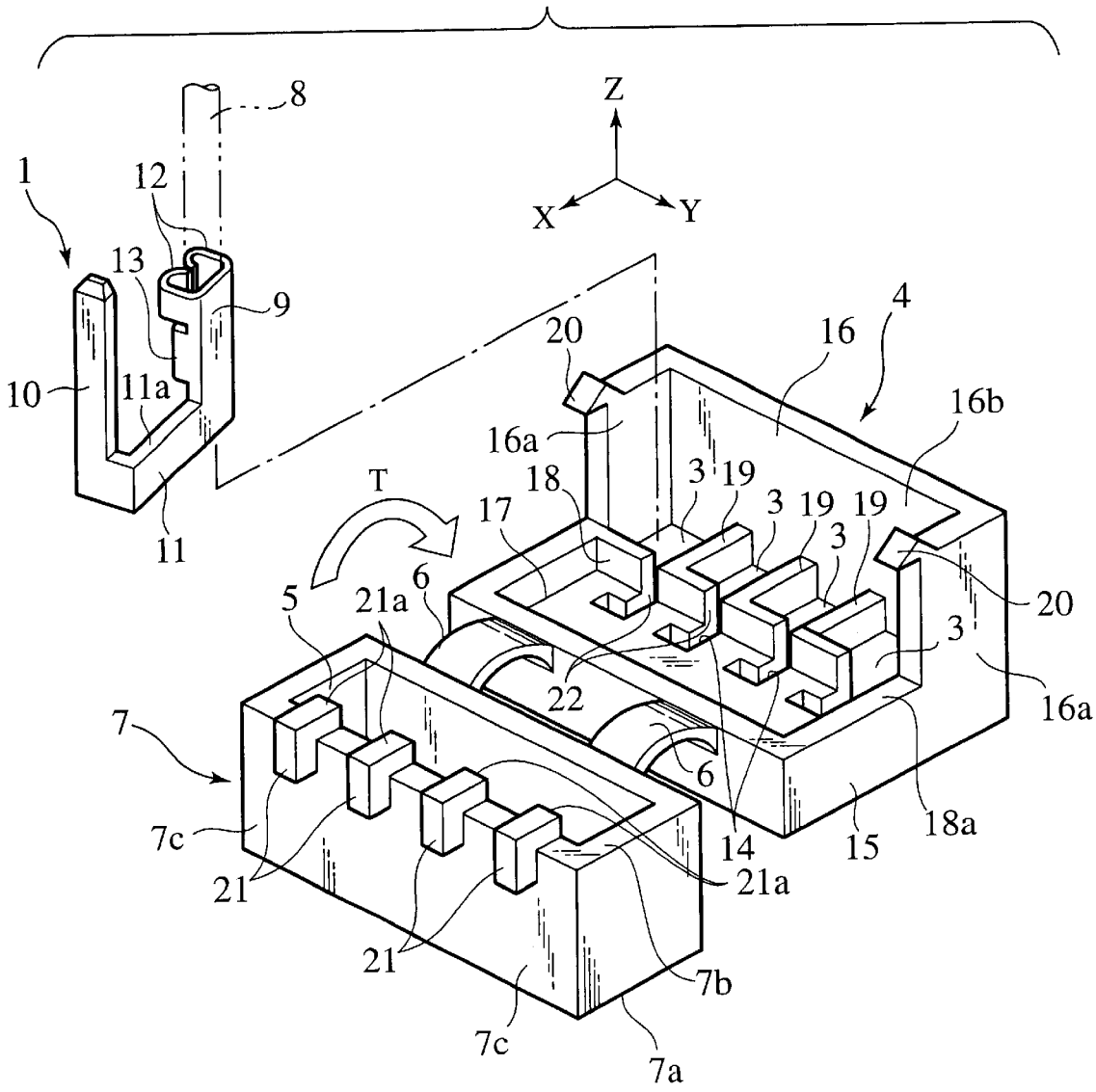
FIG. 4 is a perspective view showing a connector of the embodiment, showing a condition in which the connector is disassembled.
Figure 5:
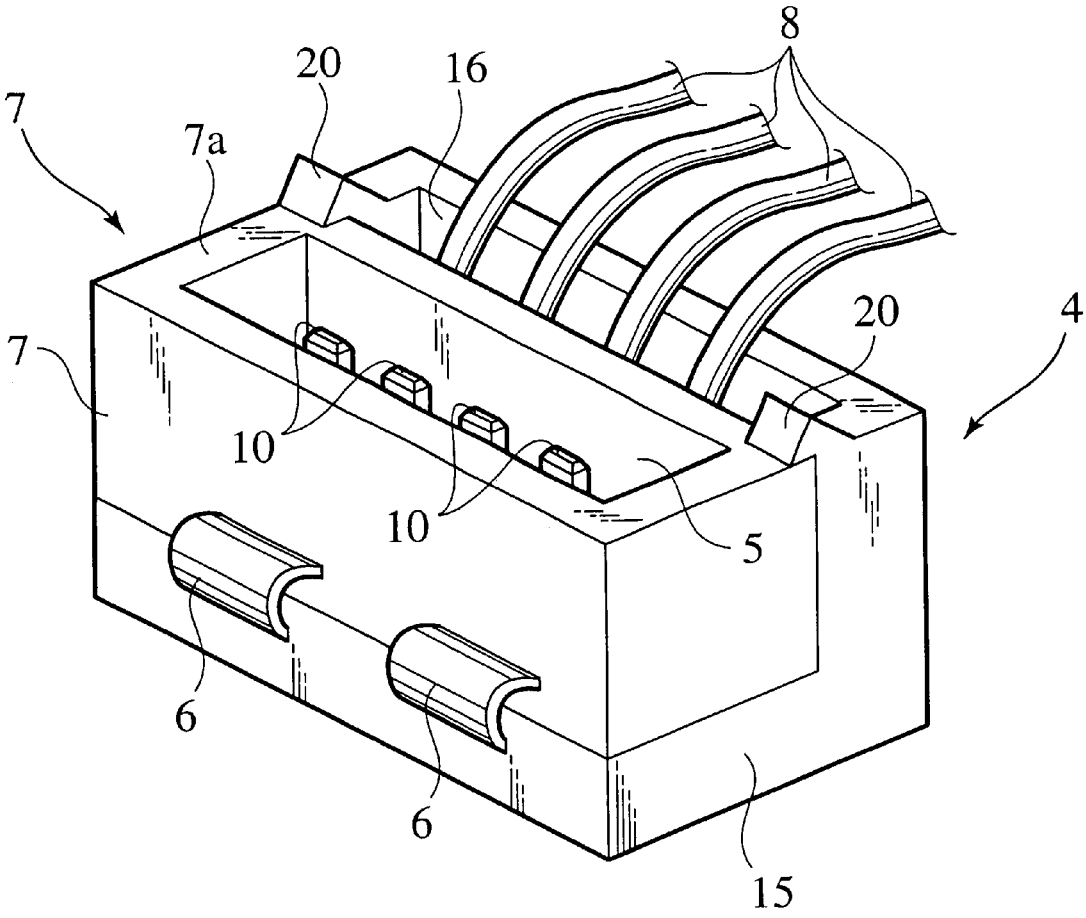
FIG. 5 is a perspective view showing a connector of the embodiment, showing a condition in which the connector is assembled.
Figure 6:
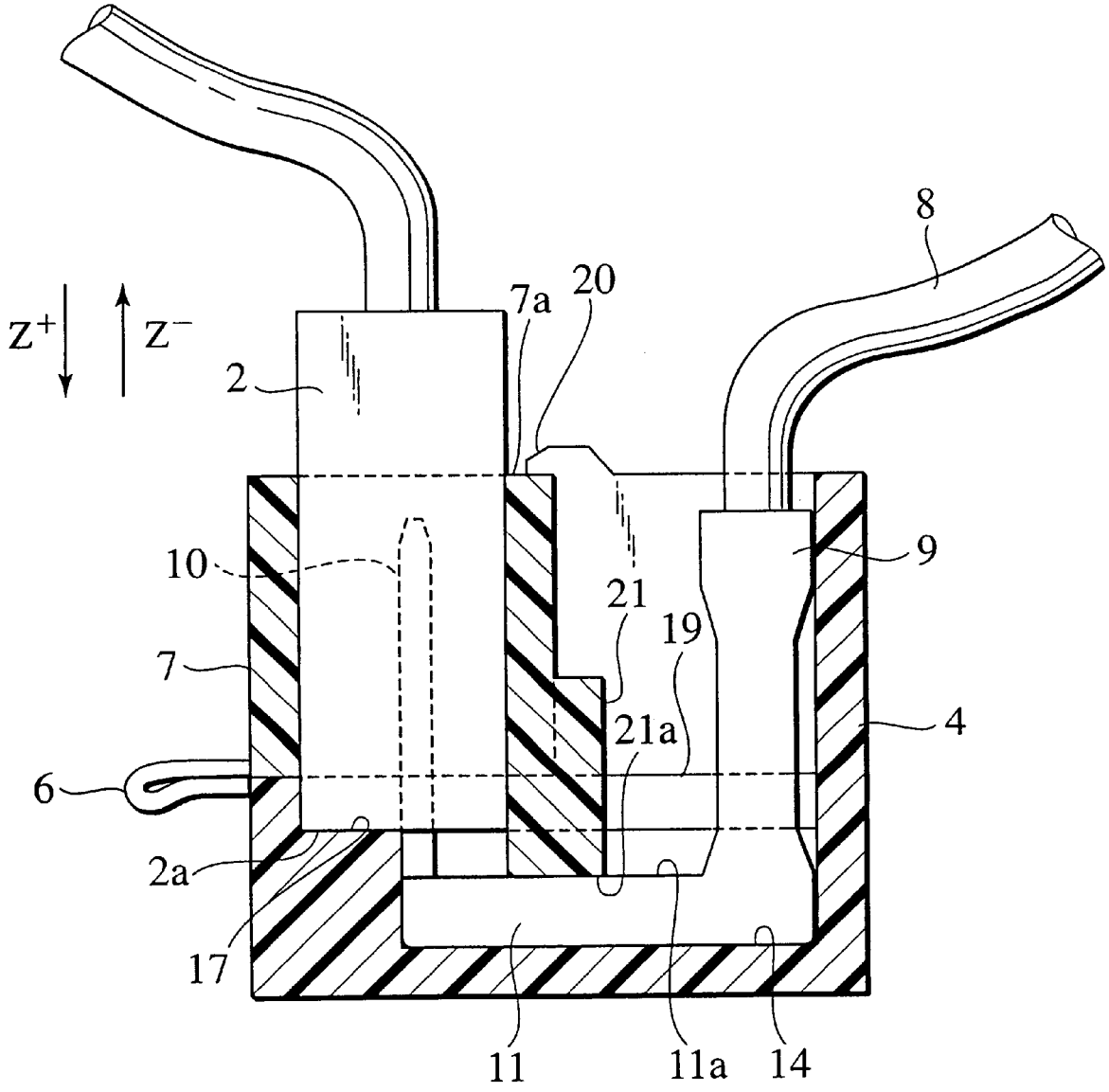
FIG. 6 is a sectional view showing a connector of the embodiment, showing a condition in which the mating connector is coupled therewith.

As shown in FIGS. 4 to 6, the connector of this embodiment comprises a connector terminal 1, a first housing 4 having a terminal accommodating chamber 3 in which the connector terminals 1 are disposed in a direction in which a mating connector 2 is inserted, and a second housing 7 having a connector insertion hole 5 allowing the mating connector to be inserted and engaged and mounted on the side of the terminal accommodating chamber 3 of the first housing 4 through a hinge portion 6 such that it is combined.

As shown in FIG. 4, the connector terminal 1 comprises a wire connecting portion 9, a terminal contact portion 10 which a mating terminal (not shown) is to contact, and a joint portion 11 for joining the wire connecting portion 9 to the terminal contact portion 10. The connector terminal 1 is formed integratedly by punching and bending a metal sheet.

As shown in FIG. 4, the wire connecting portion 9 is comprised of a wire crimping portion 12 for crimping an insulated covering portion of the wire 8 and a core crimping/connecting portion 13 for crimping a core of the wire 8. In this wire connecting portion 9, a proximal end of the core crimping/connecting portion 13, which is an end thereof, is joined to the joint portion 11, which will be described later, and the wire crimping portion 12, which is the other end, is directed upward.

The terminal contact portion 10 is a contact portion which is a rod-like tab in contact with a female terminal as a mating terminal. A proximal end of this terminal contact portion 10 is joined to the joint portion 11 and a front end thereof, which is the other end, is directed upward in the same direction as the wire connecting portion 9.

The joint portion 11 is formed in the form of a substantially L-shaped flat sheet and inserted into a terminal insertion hole 14 formed in the terminal accommodating chamber 3, which will be described later, with its short side direction (Z) as an insertion direction.

Although, the wire connecting portion 9 may be directed in any direction relative to the terminal contact portion 10, according to this embodiment, they are directed in the same direction in order to achieve reduction of the connector size. The wire connecting portion 9 and the terminal contact portion 10 are provided in the same upward (Z−) direction such that they are substantially parallel, on both ends in the length direction of the joint portion 11. As a result, the connector terminal 1 is formed in a substantially U-shape as viewed in plan.

As shown in FIGS. 4, 5, the first housing 4 is comprised of a housing coupling portion 15 with which the second housing 7 is to be coupled and a wire introducing portion 16 for introducing the wire 8 connected to the connector terminal 1 disposed in the terminal accommodating chamber 3 out of the housing. When the first housing 4 is coupled with the second housing 7, a rectangular solid is formed.

As shown in FIG. 6, a connector mounting concave portion 17, on which a front end portion 2*a* of the mating connector 2 is to be mounted, is formed in the housing coupling portion 15. The terminal insertion hole 14, in which the joint portion 11 of the connector terminal 1 is to be inserted, is formed in a bottom of the connector mounting concave portion 17. As shown in FIG. 4, the terminal insertion hole 14 is formed by cutting out part of a surrounding wall 18 composing the connector mounting concave portion 17, such that it extends between the connector mounting concave portion 17 and the wire introducing portion 16. If the joint portion 11 is engaged with this connector mounting concave portion 17, the right/left direction and the back/forth direction of the connector terminal 1 are determined.

As shown in FIG. 4, the wire introducing portion 16 is comprised of a pair of side walls 16*a*, 16*a* formed on a rear of the housing coupling portion 15 such that they rise up to a rear wall 16*b*. If the first housing 5 and the second housing 7 are coupled with each other, a rectangular space portion is formed as shown in FIGS. 5, 6. Section walls 19 are formed on a bottom of this wire introducing portion 16 so that they section the terminal accommodating chamber 3. This section wall 19 is provided substantially at right angle relative to the surrounding wall so that it joins the surrounding wall 18 to the rear wall 16*b*.

A lock pawl 20, which is a locking means for maintaining coupling condition of the first housing 4 and the second housing 7 is formed on a top end corner of each of both the side walls 16*a*, 16*a* constituting the wire introducing portion 16. As shown in FIG. 5, when the housings are coupled with each other, the lock pawl 20 is engaged with a top end face 7*a* of the second housing 7 so as to lock the coupling condition between the first housing 4 and the second housing 7.

As shown in FIGS. 4 to 6, the second housing 7 is formed as hood of a rectangular solid having the connector insertion hole 5 with which the mating connector is to be engaged. This second housing 7 can be coupled with the first housing 4 in a direction toward the terminal accommodating chamber 3 through the hinge portion 6. The second housing 7 is coupled with the first housing 4 such that a bottom end face 7*b* thereof is in contact with a top end face 18*a* of the surrounding wall 18 of the housing coupling portion 15. The hinge portion is composed of structure and material allowing coupling action and separating action for the first housing 4 and the second housing 7.

The second housing 7 has a terminal pressing member 21 for pressing the joint portion 11 of the connector terminal 1 to the terminal insertion hole 14 when the second housing 7 is coupled with the first housing 4. The terminal pressing members 21 are formed as protruded pieces, which are disposed near a bottom end of an outer side face 7*c* to be disposed on the side of the wire introducing portion 16 and invade into the cutout portions 22 formed in part of the surrounding wall 18.

As shown in FIG. 6, a bottom end face 21*a* of the terminal pressing member 21 comes into contact with a top end portion of the joint portion 11 of the connector terminal 1. That is, the terminal pressing member 21 presses a top end 11*a* of the joint portion 11 inserted into the cutout portion 22 and engaged in the terminal insertion hole 14 with its bottom end face 21*a*, so as to prevent the connector terminal 1 from escaping from the terminal insertion hole 14.

<Operations for Mounting a Connector Terminal and for Coupling the Mating Connector>

An operation for mounting the connector terminal 1 into the housing in the division type connector having the above described structure will be described. First of all, as shown in FIG. 4, the connector terminal 1 is mounted in each terminal accommodating chamber 3 in the separated first housing 4 in the same direction that the mating connector 2 is inserted. Then, the joint portion 11 of the connector terminal 1 is embedded in the terminal insertion hole 14 formed in each terminal accommodating chamber 3. If the connector terminal 1 is embedded in the terminal insertion hole 14, the connector terminal 1 is positioned in the back/forth direction (X) and right/left direction (Y).

By turning the second housing 7 in a direction indicated by an arrow T of FIG. 4, the second housing 7 is coupled with the first housing 4. Consequently, as shown in FIG. 5, the second housing 7 rides on the housing coupling portion 15 of the housing 4, so that the lock pawls 20 hold the top end face 7*a* of the second housing 7. As a result, coupling condition between the first housing 4 and the second housing 7 is locked.

The terminal pressing member 21 provided on the second housing 7 invades into the cutout portion 22, so that the bottom end face 21*a* presses the top end face 11*a* of the joint portion 11 of the connector terminal 1 from above (Z+). Consequently, the connector terminal 1 is prevented from being slipped out of the terminal accommodating chamber 3.

In this coupling condition, as shown in FIGS. 5, 6, the terminal contact portions 10 is located in the connector insertion hole 5 formed in the second housing 7 and the wire connecting portion 9 is located in the wire introducing portion 16.

Then, the mating connector 2 is inserted into the connector Insertion hole 5 in the second housing 7 locked with respect to the first housing 4. Then, a mating terminal of the mating connector 2 comes into contact with the terminal contact portion 10 in the connector insertion hole 5 and then the coupling operation is ended.

When the mating connector 2 is removed, a force in the removing direction (Z–) is applied to the second housing 7. However, because the second housing 7 is kept in the coupling condition by the lock pawls 20, the force for removing the mating connector never releases the locking condition. Because the connector terminal 1 can be mounted in the terminal accommodating chamber 3 under a condition in which the first housing 4 is separated from the second housing 7, installation of the connector terminal 1 into the terminal accommodating chamber 3 can be carried out easily. Further, because the connector terminal 1 is pressed by the terminal pressing member 21, the connector terminal 1 can be prevented from being removed from the terminal accommodating chamber 3 by the removing force for the mating connector 2. Further, because this connector is composed of the first housing 4 and the second housing 7, mechanical strength of the same connector is increased.

A specific embodiment of the present invention has been described above. However, the present invention is not restricted to the above described embodiment, but may be modified in various ways. The connector of the above described embodiment may be applied to connectors used in every field, for example, a connector for use in connecting a wire to a device contained in a sun visor mounted on a top end of a front window of automobile.

According to a first aspect of the present invention, the connector housing is comprised of the first housing having the terminal accommodating chamber and the second housing having the connector insertion hole which the mating connector is to be inserted through and engaged with. The second housing can be coupled with the first housing through the hinge portion. Thus, the connector terminal can be mounted easily into the terminal accommodating chamber under a condition in which the second housing is separated from the first housing, thereby making it possible to improve efficiency of a procedure for installing the connector terminal.

When the second housing is coupled with the first housing, the terminal pressing member formed on the second housing presses the joint portion of the connector terminal disposed in the terminal insertion hole formed in the terminal accommodating chamber, thereby making it possible to prevent the connector terminal from being slipped out of the terminal accommodating chamber.

According to a second aspect of the present invention, the lock means for holding the coupling condition between the first housing and the second housing is provided. When the first and second housing are coupled with each other, the coupling condition can be maintained until the lock means is released. Then, by releasing the lock means, the second housing can be separated from the first housing easily.

What is claimed is:

1. A connector comprising:

a connector terminal constituted of a wire connecting portion to which a wire is connected, a terminal contact portion for contacting a mating terminal of a mating connector, and a joint portion joining said wire connecting portion to said terminal contact portion;

a first housing having a terminal accommodating chamber and a terminal insertion hole, said connector terminal being disposed in said terminal accommodating chamber, said joint portion being embedded in said terminal insertion hole;

a second housing having a connector insertion hole which the mating connector is to be inserted in and engaged with, said second housing being mounted integrally with said terminal accommodating chamber of said first housing; and a terminal pressing member provided on said second housing, said terminal pressing member pressing said joint portion when the second housing is coupled with said first housing.

2. A connector according to claim 1, wherein the second housing is mounted on the first housing through a hinge portion such that said second housing is capable of being coupled with said first housing.

3. A connector according to claim 1, wherein the wire connecting portion and the terminal contact portion extend from said joint portion such that said wire is connected to the wire connection portion and said mating terminal of said mating connector contacts the terminal contact portion from a substantially same direction.

4. A connector according to claim 1, further comprising a lock means for holding the second housing coupled with the first housing.

5. A connector according to claim 1, wherein said connector insertion hole is a hole extending through said second housing.

6. A connector according to claim 1, wherein said first connector includes a connector mounting concave portion for mounting said mating connector and said terminal insertion hole is formed at a bottom of said connector mounting concave portion.

7. A connector according to claim 1, wherein said terminal insertion hole and said joint portion of said connector terminal are L-shaped.

8. A connector according to claim 1, wherein said second housing is a rectangular solid having said connector insertion hole extending therethrough.

9. A connector according to claim 1, wherein said wire connecting portion and said terminal contact portion are parallel with each other.

10. A connector according to claim 9, wherein said second connector has a side face disposed between and parallel with said wire connecting portion and said terminal contact portion when said second housing is coupled with said first housing.

11. A connector according to claim 1, wherein said terminal pressing member is a protruding piece extending from a side face of said second housing and said side face of said second housing is disposed between said wire connecting portion and said terminal contact portion when said second housing is coupled with said first housing.

* * * * *